US006210644B1

(12) United States Patent
Trokhan et al.

(10) Patent No.: US 6,210,644 B1
(45) Date of Patent: Apr. 3, 2001

(54) SLATTED COLLIMATOR

(75) Inventors: Paul Dennis Trokhan, Hamilton; Glenn David Boutilier; Timothy Jude Lorenz, both of Cincinnati, all of OH (US); Henry Louis Marlatt, Tunkhannock, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/065,164

(22) Filed: Apr. 23, 1998

(51) Int. Cl.[7] ..... B01J 19/12; F21V 11/02

(52) U.S. Cl. ..... 422/186.3; 362/290

(58) Field of Search ..... 250/237 R, 493.1; 362/290, 279; 422/131, 186.3; 118/620, 50.1; 430/5

(56) References Cited

U.S. PATENT DOCUMENTS

| | | | | |
|---|---|---|---|---|
| 3,275,820 | * | 9/1966 | Szarkowski | 396/495 |
| 3,697,758 | * | 10/1972 | Binks | 250/202 |
| 4,363,176 | | 12/1982 | Jargiello et al. | 34/275 |
| 5,832,362 | * | 11/1998 | Trokhan | 422/186.3 |

* cited by examiner

*Primary Examiner*—Shrive Beck
*Assistant Examiner*—Frederick Varcoe
(74) *Attorney, Agent, or Firm*—Vladimir Vitenberg; Larry L. Huston; Tara M. Rosnell

(57) ABSTRACT

A collimator, in combination with a source of curing radiation and a working surface, for use in a process for curing a photosensitive resin disposed on the working surface having a machine direction and a cross-machine direction perpendicular to said machine direction, is disclosed. The collimator comprises a plurality of mutually parallel collimating elements spaced from one another in the cross-machine direction and disposed between the source of radiation and the resin. Each of the collimating elements is substantially perpendicular to the working surface, and every two of the mutually adjacent collimating elements have a machine-directional clearance and a cross-machine-directional clearance therebetween. The collimating elements and the machine direction form an acute angle therebetween such that the machine-directional clearance is greater than the cross-machine directional clearance. This allows to provide a greater collimation of the curing radiation in the cross-machine direction relative to the machine direction. The collimator can be beneficially used in processes for making papermaking belts.

16 Claims, 4 Drawing Sheets

FIG. 2
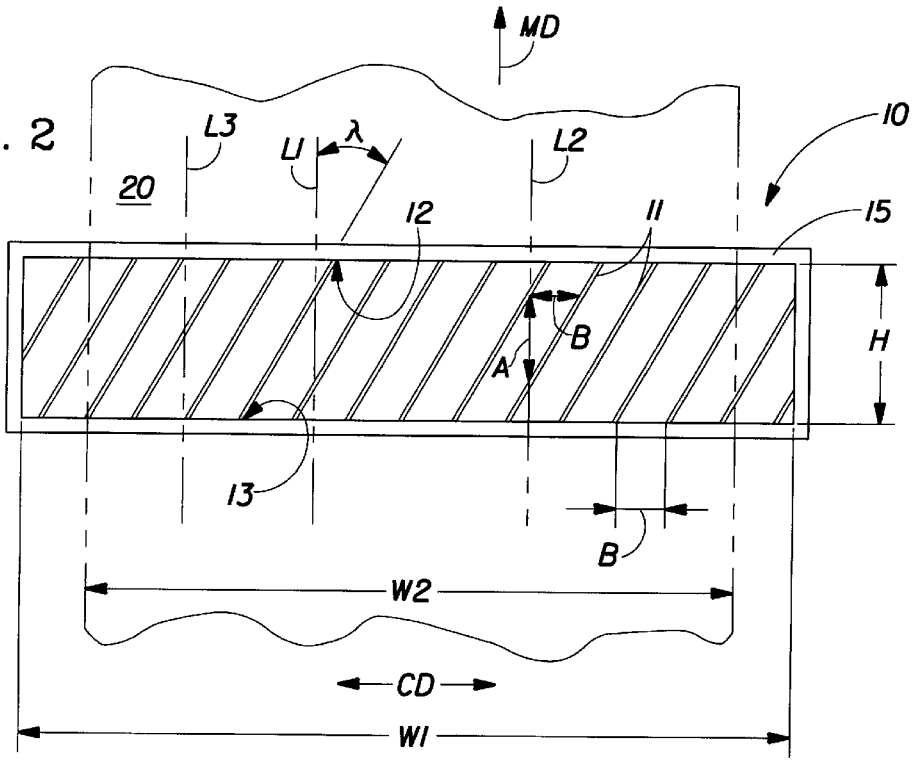
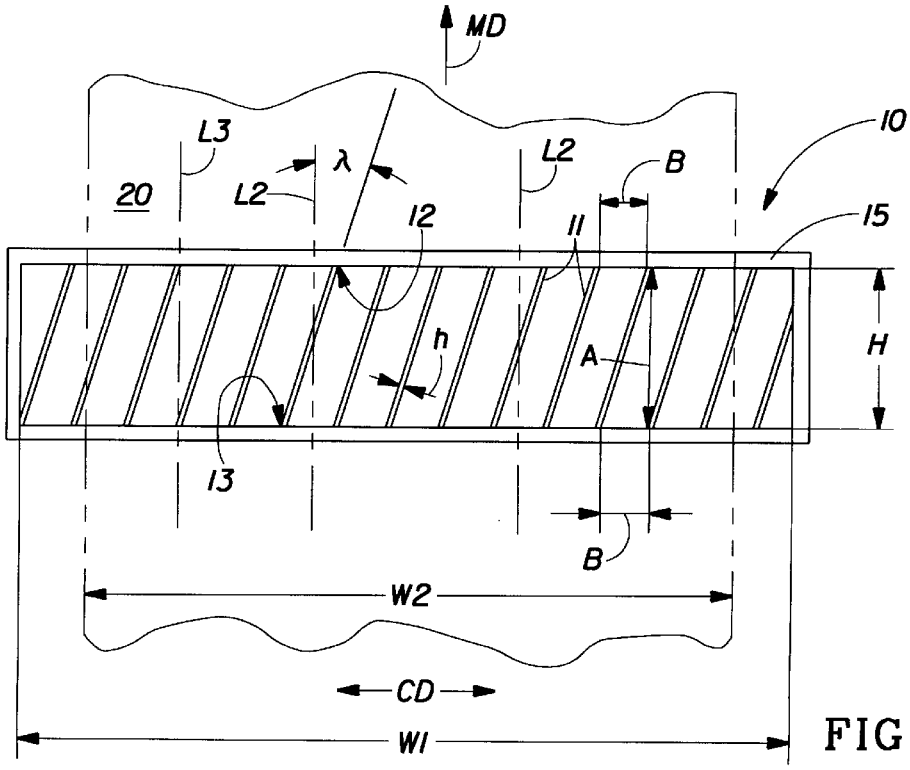
FIG. 3

SLATTED COLLIMATOR

FIELD OF THE INVENTION

The present invention is related to processes and equipment for making papermaking belts comprising a resinous framework. More particularly, the present invention is concerned with subtractive collimators used for curing a photosensitive resin to produce such a resinous framework.

BACKGROUND OF THE INVENTION

Generally, a papermaking process includes several steps. An aqueous dispersion of the papermaking fibers is formed into an embryonic web on a formations member, such as Fourdrinier wire, or a twin wire paper machine, where initial dewatering and fiber rearrangement occurs.

In a through-air-drying process, after the initial dewatering, the embryonic web is transported to a through-air-drying belt comprising an air pervious deflection member. The deflection member may comprise a patterned resinous framework having a plurality of deflection conduits through which air may flow under a differential pressure. The resinous framework is joined to and extends outwardly from a woven reinforcing structure. The papermaking fibers in the embryonic web are deflected into the deflection conduits, and water is removed through the deflection conduits to form an intermediate web. The resulting intermediate web is then dried at the final drying stage at which the portion of the web registered with the resinous framework may be subjected to imprinting—to form a multi-region structure.

Through-air drying papermaking belts comprising the reinforcing structure and the resinous framework are described in commonly assigned U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,334,289 issued to Trokhan et al on Aug. 2, 1994. The foregoing patents are incorporated herein by reference for the purpose of showing preferred constructions of through-air drying papermaking belts. Such belts have been used to produce commercially successful products such as Bounty® paper towels and Charmin Ultra® toilet tissue, both produced and sold by the instant assignee.

Presently, the resinous framework of a through-air drying papermaking belt is made by processes which include curing a photosensitive resin with UV radiation according to a desired pattern. Commonly assigned U.S. Pat. No. 5,514,523, issued on May 7, 1996 to Trokhan et al. and incorporated by reference herein, discloses one method of making the papermaking belt using differential light transmission techniques. To make such a belt, a coating of a liquid photosensitive resin is applied to the reinforcing structure. Then, a mask in which opaque regions and transparent regions define a pre-selected pattern is positioned between the coating and a source of radiation, such as UV light. The curing is performed by exposing the coating of the liquid photosensitive resin to the UV radiation from the radiation source through the mask. Typically, the curing radiation comprises both a direct radiation from the source and a reflected radiation from a reflective surface generally having an ellipsoidal and/or parabolic, or other, shape if viewed in a cross-machine directional cross-section. The curing UV radiation passing through the transparent regions of the mask cures (i. e., solidifies) the resin in the exposed areas to form knuckles extending from the reinforcing structure. The unexposed areas, which correspond to the opaque regions of the mask, remain uncured (i. e., fluid) and are subsequently removed.

The angle of incidence of the radiation has an important effect on the presence or absence of taper in the walls of the conduits of the papermaking belt. Radiation having greater parallelism produces less tapered (or more nearly vertical) conduit walls. As the conduits become more vertical, the papermaking belt has a higher air permeability, at a given knuckle area, relative to the papermaking belt having more tapered walls.

Typically, to control the angle of incidence of the curing radiation, the curing radiation may be collimated to permit a better curing of the photosensitive resin in the desired areas, and to obtain a desired angle of taper in the walls of the finished papermaking belt. One means of controlling the angle of incidence of the radiation is a subtractive collimator. The subtractive collimator is, in effect, an angular distribution filter which blocks the UV radiation rays in directions other than those desired. The U.S. Pat. No. 5,514,523 cited above and incorporated herein by reference discloses a method of making the papermaking belt utilizing the subtractive collimator. The common subtractive collimator of the prior art comprises a dark-colored, non-reflective, preferably black, structure comprising series of channels through which the curing radiation may pass in the desired directions. The channels of the prior art's collimator have a comparable size in both the machine direction and the cross-machine direction and are discrete in both the machine direction and the cross-machine direction.

While the subtractive collimator of the prior art helps to orient the radiation rays in the desired directions, the total radiation energy that reaches the photosensitive resin to be cured is reduced because of losses of the radiation energy in the subtractive collimator. Now, it has been found that these losses can be minimized, especially the losses of the curing radiation due to collimation in the machine direction. Since the papermaking belt moves in the machine direction during the manufacturing process, collimating the curing radiation in the machine direction can be achieved by controlling a machine-directional dimension of the aperture through which the curing radiation reaches the photosensitive resin. Furthermore, the ellipsoidal or parabolic general shape of the reflecting surface allows to collimate at least a reflected part of the curing radiation in the machine direction to sufficiently high degree. The collimation of the curing radiation in the cross-machine direction, however, cannot be controlled by adjusting the aperture's cross-machine-directional dimension, simply because the aperture's cross-machine-directional dimension must be no less than the width of the belt being constructed. Also, the ellipsoidal and parabolic reflective surfaces are designed to change the angular distribution of the curing (reflected) radiation primarily in the machine direction, and not the cross-machine direction. Therefore, the curing radiation output and the efficiency of the whole process for making the belt may be significantly increased by reducing losses of the radiation due to collimating the radiation in the machine direction while maintaining the necessary level of collimating in the cross-machine direction.

Therefore, it is an object of the present invention to provide a novel subtractive collimator for use in the processes for curing the photosensitive resin for producing a papermaking belt having the resinous framework, which collimator significantly reduces the loss of the curing energy.

It is another object of the present invention to provide a novel slatted collimator designed to decouple collimation of the curing radiation in the machine direction from the collimation of the curing radiation in the crossmachine direction.

It is also an object of the present invention to provide an improved process for curing a photosensitive resin, using such a slatted collimator of the present invention.

BRIEF SUMMARY OF THE INVENTION

A subtractive slatted collimator of the present invention allows one to maintain the necessary degree of a subtractive collimation of a curing radiation in a cross-machine direction while reducing the subtractive collimation of the curing radiation in a machine direction, thereby significantly reducing losses of the curing energy.

In an exemplary process of the present invention, the liquid photosensitive resin , in the form of a resinous coating having a width, is supported on a working surface having the machine direction and the cross-machine direction perpendicular to the machine direction. A source of curing radiation is selected to provide radiation primarily within the wavelength range which causes curing of the liquid photosensitive resin. The collimator is disposed between the source of the curing radiation and the photosensitive resin being cured. Preferably, the coating of the photosensitive resin travels in the machine direction.

In the preferred embodiment, the collimator of the present invention comprises a frame and a plurality of mutually parallel collimating elements, or slats, supported by the frame. Preferably, every collimating element has a uniform thickness, and all the collimating elements have the same thickness within the open area defined by the frame. The collimating elements are spaced in the cross-machine direction within the open area defined by the frame, preferably at equal distances from one another. While the mutually parallel and equally spaced in the cross-machine direction collimating elements are preferred, the present invention contemplates the collimating elements which are not parallel to one another and/or not equally spaced in the cross-machine direction.

The frame defines an open area through which the curing radiation can reach the photosensitive resin to cure the photosensitive resin according to a predetermined pattern. The open area defined by the frame has a width (measured in the cross-machine direction) and a length (measured in the machine direction). Preferably, the width of the open area is equal to or greater than the width of the resinous coating being cured. Preferably, the plurality of the collimating elements is disposed within the open area such that each of the collimating elements is substantially perpendicular to the surface of the resinous coating. The collimating element is defined herein as a discrete element oriented in one predetermined direction in plan view within the open area defined by the frame, and designed to substantially absorb the curing radiation. Preferably, each of the collimating elements comprises a relatively thin, radiation-impermeable and substantially non-reflective sheet capable of maintaining its shape and position substantially perpendicular relative to the surface of the resinous coating.

Every two mutually adjacent collimating elements have a machine-directional clearance and a cross-machine-directional clearance therebetween. A pitch at which two adjacent collimating elements are spaced in the cross-machine direction comprises a sum of the cross-machine-directional clearance and a projection of the thickness of the individual collimating element to the cross-machine direction (which projection is defined herein as a "cross-machine directional thickness" of the collimating element). The machine-directional clearance between two mutually adjacent collimating elements is greater than the cross-machine-directional clearance between the same mutually adjacent collimating elements. The collimating elements and the machine direction form an acute angle therebetween, which acute angle is less than 45°. Preferably, but not necessarily, all collimating elements form the same angle with the machine direction. However, the embodiment is possible, in which the different collimating elements form differential acute angles between the collimating elements and the machine direction. Preferably, the acute angle formed between the collimating elements and the machine direction is from 1° to 44°. More preferably, the acute angle is from 5° to 30°. Most preferably, the acute angle is from 10° to 20°.

In the preferred embodiment, the collimating elements are disposed such that all differential machine-directional micro-regions (i. e., the differential micro-regions running in the machine direction) of the resinous coating, distributed throughout the width of the coating, receive equal amounts of the curing radiation while the resinous coating travels in the machine direction during the process of making the belt. To accomplish this, each of the machine-directional micro-regions which is being cured is shielded from the curing radiation by the collimating elements for the same period of time, as the resinous coating moves at a constant velocity in the machine direction under the curing radiation.

Each of the collimating elements has a first end and a second end opposite to the first end. The first and second ends are adjacent to the frame, and preferably the frame supports the collimating elements by providing a support for the ends. In the preferred embodiment, the collimating elements are disposed within the open area such that the first end of one collimating element aligns in the machine direction with the second end of another collimating element. In the preferred embodiment, interdependency between the acute angle formed between the collimating element(s) and the machine direction, the length of the open area, and the pitch at which the collimating elements are spaced from one another in the cross-machine direction can be generically expressed by the following equation: tangent of the acute angle equals to the pitch multiplied by an integer and divided by the length of the open area.

The collimator of the present invention provides a greater degree of the cross-machine-directional collimation of the curing radiation relative to the machine-directional collimation of the curing radiation. By providing the differential collimation of the curing radiation in the machine direction and the cross-machine direction, the collimator of the present invention effectively decouples the machine-directional collimation and the cross-machine-directional collimation.

BRIEF DESCRIPTION OF THE DRAWINGS

FIG. 2 is a view taken along lines 2—2 of FIG. 1, and showing a schematic plan view of one preferred embodiment of the slatted collimator of the present invention.

FIG. 3 is a schematic plan view of another preferred embodiment of the slatted collimator of the present invention.

DETAILED DESCRIPTION OF THE INVENTION

A collimator 10 of the present invention may be successfully used for curing a photosensitive resin in processes for making papermaking belts. Such papermaking belts are described in several commonly-assigned and incorporated herein by reference patents referred to in the Background.

Figure 1:
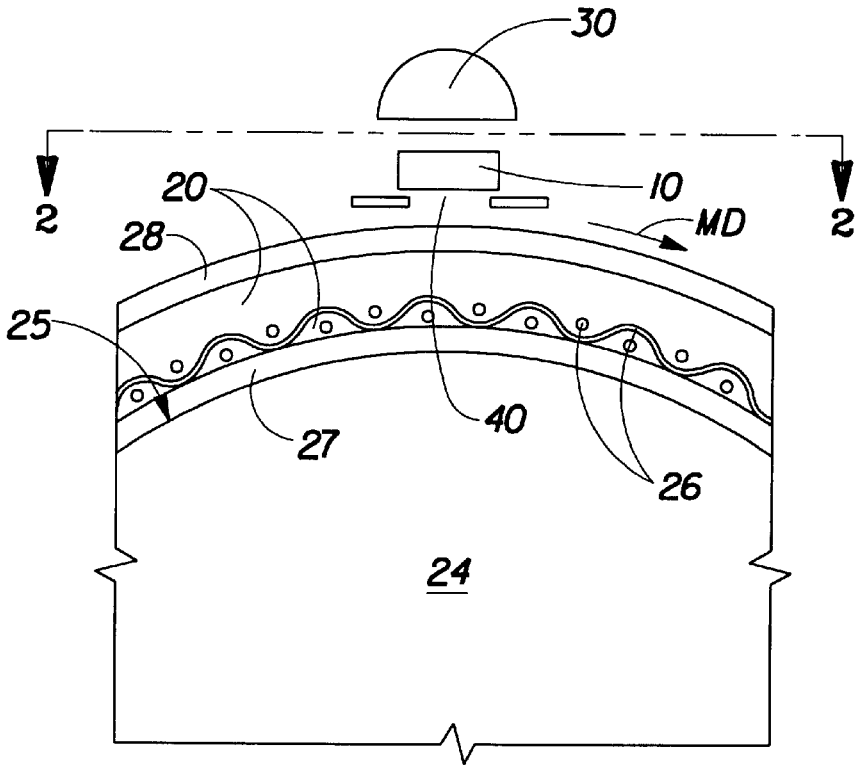
FIG. 1 is a schematic side elevation view of a process of the present invention, using a slatted collimator of the present invention.

FIG. 1 schematically shows a fragment of a process of the present invention for making a papermaking belt comprising a photosensitive resin. In FIG. 1, a liquid photosensitive resin 20, in the form of a resinous coating, is supported by a working surface 25. The working surface 25 may have a substantially plane configuration (not shown). Alternatively, the working surface 25 may be curved as shown in FIG. 1. Commonly-assigned and incorporated by reference herein U.S. Pat. Nos. 4,514,345; 5,098,522; 5,275,700; and 5,364,504 disclose processes of making a papermaking belt by casting a photosensitive resin over and through a reinforcing structure and then exposing the resin to a curing radiation through a mask. In FIG. 1, the reinforcing structure 26 is supported by a forming unit comprising a drum 24 having the cylindrical working surface 25. The drum 24 is rotated by a conventional means well known in the art and therefore not illustrated herein. The working surface 25 of the drum 24 may be covered with a barrier film 27 to prevent the working surface 25 from being contaminated with the resin 20. A mask 28 having transparent regions and opaque regions may be juxtaposed with the resinous coating 20 to provide curing of only those portions of the resin 20, which portions correspond to the transparent regions of the mask 28 and therefore are unshielded from the curing radiation. In the embodiment illustrated in FIG. 1, the barrier film 27, the reinforcing structure 26, the photosensitive resinous coating 20, and the mask 28 all form a unit which travels together in a machine direction. As used herein, the term "machine direction" (designated as MD in drawings) refers to a direction which is parallel to the flow of the papermaking belt being constructed through the equipment. A cross-machine direction (designated as CD in drawings) refers to a direction which is perpendicular to the machine direction and parallel to the general surface of the belt being constructed. By analogy, an element (direction, dimension, etc.) defined herein as "machine-directional" means an element (direction, dimension, etc.) which is parallel to the machine direction; and an element defined herein as "cross-machine-directional" means an element (direction, dimension, etc.) which is parallel to the cross-machine direction.

A source of curing radiation 30 is, generally, selected to provide radiation primarily within the wavelength range which causes curing of the liquid photosensitive resin 20. Any suitable source of radiation, such as Mercury arc, pulsed Xenon, electrodeless lamps, and fluorescent lamps, can be used. The intensity of the radiation and its duration depend upon the degree of curing required in the exposed areas. Co-pending and commonly-assigned patent applications Ser. No. 08/1799,852 entitled "Apparatus for Generating Parallel Radiation for Curing Photosensitive Resin," filed May 14, 1997 in the name of Trokhan; Ser. No. 08/858,334 entitled "Apparatus for Generating Controlled Radiation for Curing Photosensitive Resin," filed May 19, 1997 in the name of Trokhan et al., and its continuation entitled "Apparatus for Generating Controlled Radiation for Curing Photosensitive Resin," filed Oct. 24, 1997 in the name of Trokhan et al. are incorporated herein by reference. These applications disclose an apparatus which allows to direct the curing radiation in a substantially predetermined direction.

The intensity of the curing radiation and an angle of incidence of the curing radiation can have an important effect on the quality of a resinous framework of the papermaking belt being constructed. As used herein, the term "angle of incidence" of the curing radiation refers to an angle formed between a direction of rays of the curing radiation and a perpendicular to the surface of the resin being cured. If, for example, a papermaking belt having deflection conduits is being constructed, the angle of incidence is important for creating correct taper in the walls of the conduits. The papermaking belt having deflection conduits is disclosed in several commonly-assigned and above-referenced patents.

In addition to having an effect on the tapering of the walls of the conduits, the angle of incidence may effect air-permeability of the hardened framework of the papermaking belt. It should be apparent to one skilled in the art that a high degree of collimation of the curing radiation facilitates formation of the conduits having walls which are less tapered, i. e., more "vertical." The belt having less tapered conduits' walls has a higher air-permeability relative to a similar belt having greater tapered conduits' walls, all other characteristics of the compared belts being equal. It is so because at a given conduit's area and the resin's thickness the total belt's area through which the air can flow is greater in the belt having the conduits with the relatively less tapered walls.

In the industrial-scale processes of making the belt, the resinous coating 20 travels in the machine direction, as shown in FIG. 1 and discussed above. The movement of the resinous coating 20 in the machine direction tends to level possible variations of the intensity of the curing radiation in the machine direction. This leveling of the curing radiation's intensity does not occur, however, in the cross-machine direction, simply because the photosensitive resinous coating does not travel in the cross-machine direction. Also, a machine-directional dimension of an aperture 40 through which the curing radiation reaches the photosensitive resin may be effectively controlled to collimate the curing radiation in the machine direction. Furthermore, the ellipsoidal or parabolic shape of the reflecting surface of the source of radiation 30 may be used to control in the machine direction a degree of collimating at least a reflected part of the curing radiation.

Figure 5:
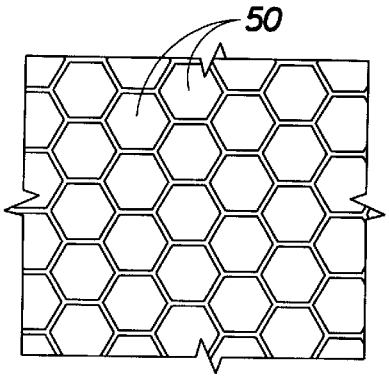
FIG. 5 PRIOR ART
FIG. 5 is a schematic plan view of an embodiment of a subtractive collimator of the prior art, comprising a plurality of discrete channels.
Figure 6:
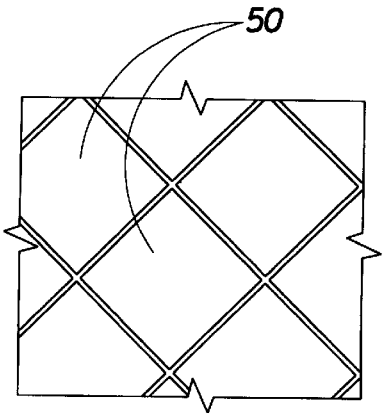
FIG. 6 PRIOR ART
FIG. 6 is a schematic plan view of another embodiment of the subtractive collimator of the prior art, comprising a plurality of discrete channels.

Therefore, without wishing to be limited by theory, the applicant believes that reducing the collimation of the curing radiation in the machine direction with the subtractive collimator provides a significant benefit of saving energy and/or reducing losses of the intensity of the curing radiation, relative to the processes using subtractive collimators of the prior art. Subtractive collimators of the prior art, schematically shown in FIGS. 5 and 6, generally comprise a plurality of sections 50 which are discrete in both the machine direction and the cross-machine direction and which have approximately equal dimensions of the areas which are open to radiation in both the machine direction and the cross-machine direction. Therefore, the collimators of the prior art collimate the curing radiation in both the machine direction and the cross-machine direction relatively equally. In contrast, the collimator 10 of the present invention allows to significantly reduce the machine-directional collimation of the curing radiation while maintaining the necessary degree of the cross-machine-directional collimation.

The preferred collimator 10, a plan view of which is schematically shown in FIGS. 2 and 3, comprises a frame 15 supporting a plurality of mutually parallel collimating elements 11. As used herein, the term "collimating element" 11 refers to a discrete element, designed to absorb, at least partially, the curing radiation, and oriented in a certain predetermined direction within the frame 15, as schematically shown in FIGS. 2, 3, and 4. While the frame 15 is shown as a rectangular structure in FIGS. 2 and 3, the frame 15 may have other shapes, if desirable. The major function of the frame 15 is to support the collimating elements 11 in a position which will be discussed herein below. In FIGS. 2 and 3, the frame 15 defines an open area through which a curing radiation can reach the photosensitive resin 20 to cure the resin 20 according to a predetermined pattern. The open area defined by the frame 15 has a cross-machine-directional width W1 and a machine-directional distance H. Preferably, the width W1 is equal to (not shown) or greater than (FIGS. 2 and 3) a width W2 of the resinous coating 20.

The plurality of the collimating elements 11 is disposed within the open area formed by the frame 15. Each of the collimating elements 11 is substantially perpendicular to the surface of the resinous coating 20. Preferably, each of the collimating elements 11 comprises a relatively thin, radiation-impermeable sheet capable of maintaining its shape and perpendicularity relative to the surface of the resinous coating 20 under a temperature from approximately 100° F. to approximately 500° F. The collimating elements 11 may be biased, tensioned, or free-standing to accommodate a possible thermal expansion due to heating by the curing radiation. It should also be appreciated that the collimating elements 11 may extend beyond the dimensions of the frame 15 and beyond the dimensions of the open area for tensioning, biasing, or other purposes. Preferably, the elements 11 are painted in non-reflective black for maximal absorption of the radiation energy.

As shown in FIGS. 2, 3, and 4, the collimating elements 11 are consecutively spaced from one another in the cross-machine direction within the open area formed by the frame 15. Each of the collimating elements 11 is oriented in one predetermined direction. Preferably, any two adjacent collimating elements do not mutually abut within the open area defined by the frame 15. Each of the collimating elements 11 has a first end 12 and a second end 13 opposite to the first end 12. As defined herein, the first end 12 is disposed farther in the machine direction relative to the second end 13. The first and second ends 12, 13 are adjacent to the frame 15, and preferably the frame 15 supports the collimating elements 11 by providing support for the ends 12 and 13. If desired, the collimating elements 11 may extend beyond the open area 15 and beyond the frame 15. Thus, the ends 12 and 13 may be more generically defined herein as geometrical points at which the collimating elements 11 intersect boundaries of the open area through which the curing radiation reaches the photosensitive resin 20. In the preferred embodiments shown in FIGS. 2 and 3, the collimating elements 11 are disposed within the open area formed by the frame 15 in such a way that the first end 12 of one collimating element 11 aligns in the machine direction with the second end 13 of the other collimating element 11, as will be shown in greater detail below.

As FIGS. 2 and 3 show, preferably the collimating elements 11 are equally spaced from one another. Every two mutually adjacent collimating elements 11 have a machine-directional clearance A and a cross-machine-directional clearance B therebetween. As used herein, the term "machine-directional clearance" means a distance measured in the machine direction between two adjacent collimating elements 11 within the frame 15. The term "cross-machine-directional clearance" means a distance measured in the cross-machine direction between two adjacent collimating elements 11 within the frame 15. In the preferred embodiment of the collimator 10, shown in FIGS. 2 and 3, and comprising the collimating elements 11 which are mutually parallel and equally spaced from one another within the frame 15, the cross-machine-directional clearance B is constant for a given collimator 11. The present invention, however, contemplates embodiments of the collimator 10 having the collimating elements 11 which may be unequally spaced from one another and/or may not be parallel to one another (FIG. 4), as will be explained in more detail below. The cross-machine-directional clearance between two collimating elements which are not mutually parallel is defined herein, with reference to FIG. 4, as a calculated average between a first distance B12 formed between the first ends 12 of the two adjacent non-parallel collimating elements 11 and a second distance B13 between the second ends of the same adjacent non-parallel collimating elements 11 (designated in FIG. 4 as between the collimating elements 11*a* and 11*b*, and between the collimating elements 11*c* and 11*d*). According to the present invention, the machine-directional clearance A is greater than the cross-machine-directional clearance B, within the frame 15. The collimating elements 11 and the machine direction form an acute angle $\lambda$ therebetween, which acute angle $\lambda$ is less than 45°. This structure provides a greater degree of collimating the curing radiation in the cross-machine direction relative to the machine direction. By providing the differential collimation of the curing radiation in the machine direction and the cross-machine direction, the collimator 10 of the present invention effectively decouples the machine-directional collimation from the cross-machine-directional collimation.

It should be pointed out that the collimating elements need not be planar as shown in FIGS. 2 and 3. The present invention contemplates the use of the collimating elements 11*c* which are curved, as schematically shown in FIG. 4. The curved collimating element 11*c* is oriented in a direction parallel to a line connecting the first end 12 and the second end 13 of the curved collimating element 11*c*. In the instance of the curved collimating element(s), the acute angle $\lambda$ is defined herein as an angle (designated as $\lambda c$ in FIG. 4) between the machine direction and the line connecting the first end 12 and the second end 13 of the curved collimating element 11*c*.

In the preferred embodiment of the collimator 10 of the present invention, shown in FIGS. 2 and 3, the collimating elements 11 are disposed such that all micro-regions of the resinous coating 20, which are distributed throughout the width W2 of the coating 20 (i. e., the machine-directional micro-regions), receive equal amounts of the curing radiation when the resinous coating 20 travels in the machine direction during the process of making the belt. To illustrate this, in FIGS. 2 and 3 a phantom line L1 represents one exemplary and arbitrarily chosen machine-directional micro-region of the resinous coating 20, and a phantom line L2 represents another exemplary and arbitrarily chosen machine-directional micro-region of the coating 20. The two separate micro-regions L1 and L2 are mutually parallel and spaced from each other in the cross-machine direction. As the resinous coating 20 travels in the machine direction, each of the lines L1 and L2 intersects the collimating elements 11 an equal number of times. In FIG. 2 each of the lines L1 and L2 intersects the elements 11 twice; and in FIG. 3 each of the lines L1 and L2 intersects the elements 11 once. If the velocity of the resinous coating 20 is constant and all the collimating elements 11 have the same thickness h (FIG. 3), the micro-region L1 of the coating 20 is shielded from the curing radiation for the same period of time as the micro-region L2 is shielded from the curing radiation. Consequently, both micro-regions L1 and L2 receive the same amount of curing radiation within the open area of the collimator 10, as the resinous coating 20 moves in the machine direction at a constant velocity. By analogy, one skilled in the art will readily understand that each and every of the unlimited number of the micro-regions differentiated in the cross-machine direction throughout the width W2 of the resinous coating 20, receives an equal amount of radiation within the open area of the collimator 10, as the resinous coating 20 travels in the machine direction at the constant velocity.

In FIG. 2, the first end 12 of the collimating element 11 is aligned, in the machine direction, with the second end 13 of the every second collimating element 11 spaced in the cross-machine direction. In FIG. 3, the first end 12 of the collimating element 11 is aligned, in the machine direction, with the second end 13 of the adjacent collimating element 11 spaced in the cross-machine direction. To more comprehensively illustrate a difference between these two arrangements, a line L3 is shown in both FIGS. 2 and 3. The line L3 is a machine-directional "border-line" representing a machine-directional micro-region interconnecting two opposite ends 12 and 13 of two separate collimating elements 11, which ends 12, 13 are mutually aligned in the machine direction. While the thickness h of the collimating elements 11 is preferably small relative to the overall dimensions W1 and H of the frame 15, the line L3, when intersecting the elements 11 at their ends 12, 13, is preferably shielded from the curing radiation by the same resulting machine-directional thickness of the collimating element(s) 11 being intersected, as each of the lines L1 and L2 is shielded from the curing radiation. In the preferred embodiment of the present invention, any machine-directional line running through the open area intersects an equal resulting projected machine-directional thickness of the collimating elements 11. Thus, the resulting amount of the curing radiation received by the micro-regions L1, L2, and L3 is equal throughout the width W2 of the resinous coating 20, as the resinous coating 20 travels in the machine direction at a constant velocity. In the preferred embodiment, therefore, the thickness h of the collimating elements 11 has virtually no effect on equal distribution of the curing radiation in the cross-machine direction.

Figure 3A:
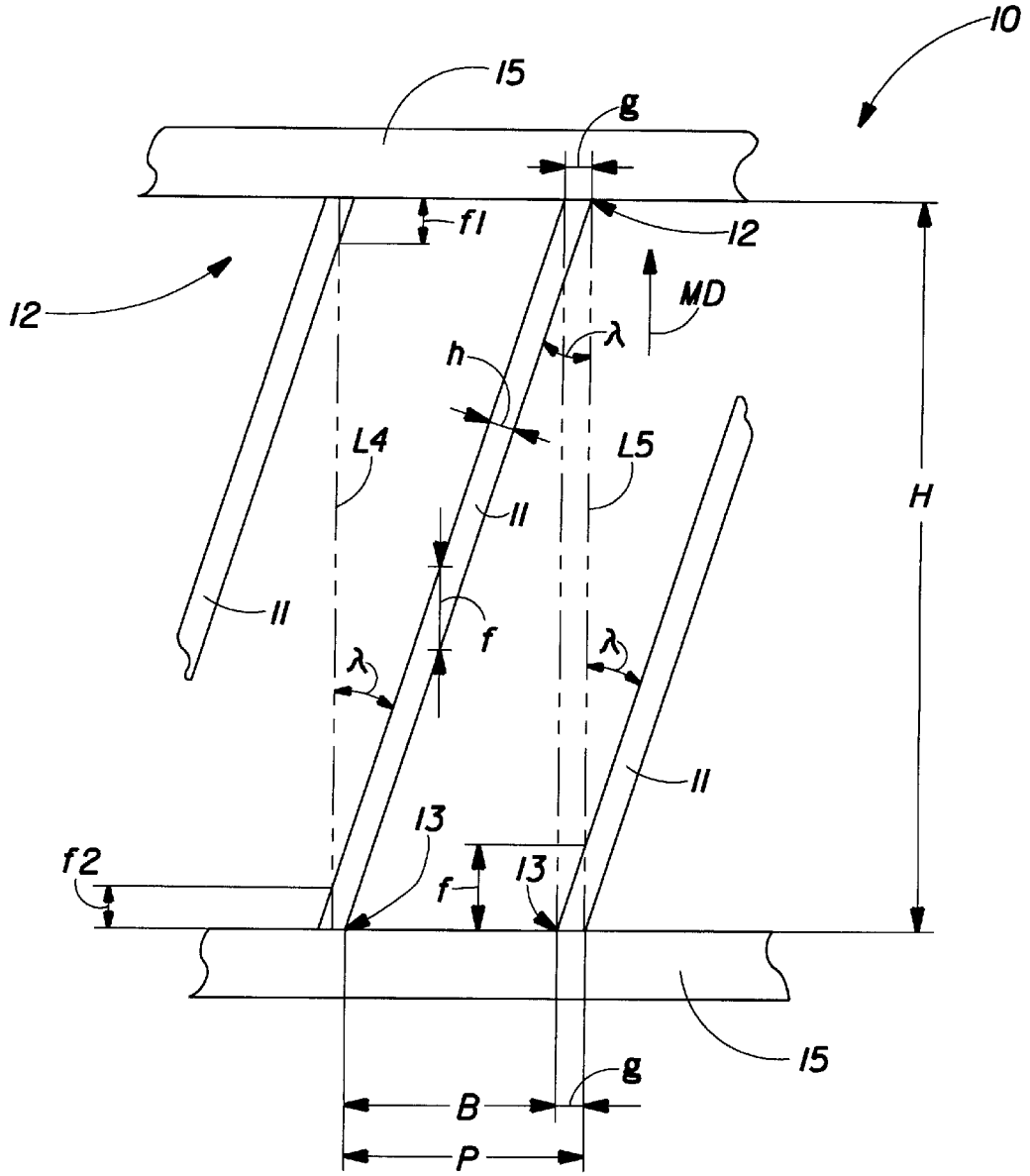
FIG. 3A is a schematic fragmental view of the embodiment shown in FIG. 3.
Figure 4:
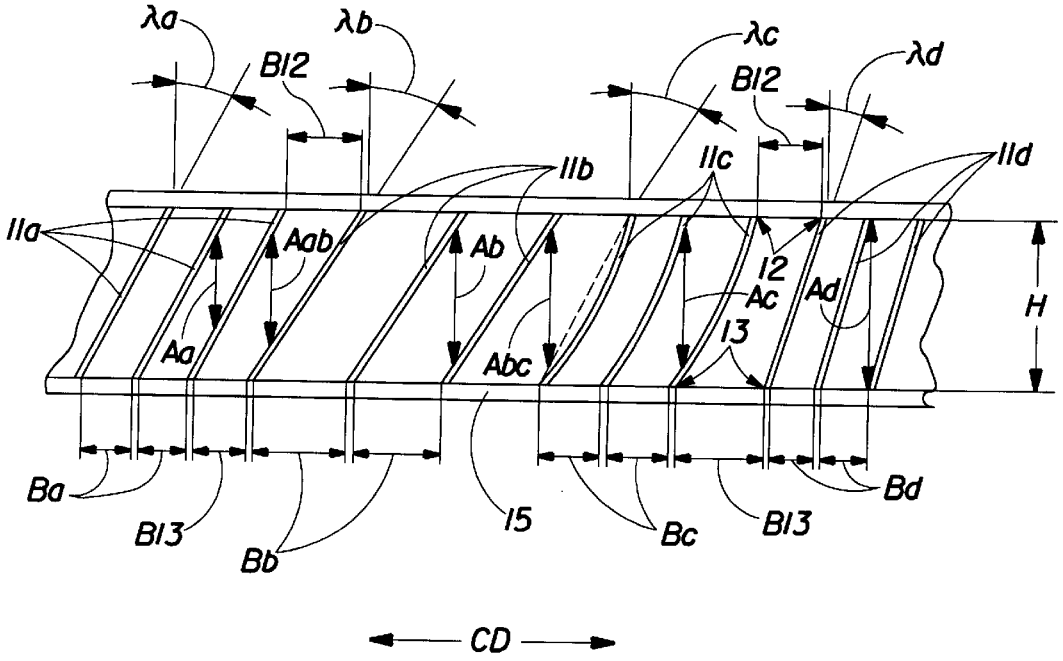
FIG. 4 is a schematic plan view of still another embodiment of the slatted collimator of the present invention.

FIG. 3A, schematically showing an elevated fragment of the preferred collimator 10, illustrates what is meant by the term "resulting projected machine-directional thickness" of the collimating element(s) 11. In FIG. 3A, the collimating elements 11 are mutually parallel and equally spaced from one another. As used herein, the term "projected machine-directional thickness" refers to a projection of the thickness h of the collimating element 11 to the machine direction, or—in other words—the thickness of the collimating element 11 measured in the machine direction. Analogously, a term "projected cross-machine directional thickness" refers to a projection of the thickness h to the cross-machine direction, or the thickness of the collimating element 11 measured in the cross-machine direction. In FIG. 3A, each of the collimating elements has the uniform thickness h, the projected machine-directional thickness of the collimating element 11 is designated as f, and the projected cross-machine directional thickness of the collimating element 11 is designated as g. In FIG. 3A, the first end 12 of the collimating element 11 is aligned in the machine direction with the second end 13 of the adjacent collimating element 11, such that the projected cross-machine-directional thickness of the first end 12 of one collimating element 11 is aligned with the projected cross-machine-directional thickness of the second end 13 of the other collimating element 11. Thus, the collimating elements 11 are equally spaced in the cross-machine direction, from one another at a pitch P=B+g. The pitch P is measured in the machine direction. One skilled in the art will readily appreciate that the projected machine-directional thickness f equals to the thickness h divided by a sine of the angle λ, or $f=h/\sin\lambda$); and the projected cross-machine-directional thickness g equals to the thickness h divided by a cosine of the angle λ, or $g=h/\cos\lambda$.

In FIG. 3A, a line L4 represents a machine-directional micro-region which intersects, in the machine direction, two adjacent collimating elements 11, thereby defining two fractions of the projected machine-directional thickness f: a fraction f1 of one of the collimating element 11, and a fraction f2 of the other collimating element 11. A sum of the fractions f1+f2 defines the resulting projected machine-directional thickness of the collimating element(s) 11. A line L5 represents a machine-directional region which intersects, in the machine direction, only one collimating element 11 having the thickness h. In FIG. 3A, each of the line L4 and the line L5 intersects the same resulting projected machine-directional thickness which is equal, in this instance, to the projected machine-directional thickness f of the single collimating element 11. While in the embodiment illustrated in FIG. 3A the resulting machine-directional thickness equals to the machine-directional thickness f of the single collimating element 11, one skilled in the art should appreciate that in other embodiments the resulting machine-directional thickness may be less (not shown) or greater (FIG. 2) than the machine-directional thickness f of the single collimating element 11. In the embodiment shown in FIG. 2, for example, the resulting projected machine-directional thickness equals to the double machine-directional thickness, or 2*f*. Embodiments are possible, in which the resulting projected machine-directional thickness differentiate throughout the width W2 of the resinous coating 20. The resulting projected machine-directional thickness may differentiate throughout the cross-machine direction if, for example, the first end 12 of one collimating element 11 does not align with the second end 13 of the other collimating element 11, or if the collimating element(s) 11 has (have) a non-uniform thickness, both instances being contemplated by the present invention.

In the embodiment shown in FIGS. 3 and 3A, in which the first end 12 of one collimating element 11 is aligned with the second end 13 of the adjacent collimating element 11, an interdependency between the angle λ, the machine-directional distance H of the open area, and the cross-machine-directional clearance B can be expressed according to the following equation: $\tan\lambda=(B+g)/H$, where "tan λ" is a tangent of the angle λ. In the embodiment shown in FIG. 2, in which the first end 12 of the collimating element 11 is aligned with the second end 13 of every second collimating element 11, the interdependency between the angle λ, the machine-directional distance H of the open area, and the cross-machine-directional clearance B can be expressed as: $\tan \lambda=(B+g)/H$. One skilled in the art will understand that in the embodiment (not shown) in which the first end 12 of the collimating element 11 is aligned with the second end 13 of every third collimating element 11, the same interdependency can be expressed as: $\tan \lambda=3(B+g)/H$. Therefore, in the preferred embodiment of the present invention, the interdependency between the angle $\lambda$, the machine-directional distance H of the open area, and the cross-machine-directional clearance B between the adjacent collimating elements 11 can be generically expressed as an equation: $\tan \lambda=n(B+g)/H$, where n is an integer. Consequently, the angle $\lambda$ equals to an arctangent of $n(B+g)/H$. The preferred angle $\lambda$ is in the range from 1° to 44°. The more preferred angle $\lambda$ is in the range from 5° to 30°. The most preferred angle $\lambda$ is in the range from 10° to 20°.

While the embodiments of the collimator 10 shown in FIGS. 2 and 3 are preferred, other arrangements of the collimating elements 11 within the frame 15 are possible. For example, the first and second ends 12, 13 of the collimating elements 11 might not be aligned in the machine direction (not shown). The latter embodiment still provides the benefit of decoupling the machine-directional collimation and the cross-machine-directional collimation, as well as saving energy by reducing the machine-directional collimation, especially if the preferred thickness of the collimating elements 11 is negligibly small relative to the dimensions of the open area formed by the frame 15; therefore it is believed that possible variations of the curing radiation's intensity due to the interference of the unaligned ends 12, 13 will not significantly affect the cross-machine-directional distribution of the curing radiation throughout the surface of the resin 20.

Other possible embodiments of the collimator 10 comprising collimating elements 11 having aligned ends 12 and 13 are possible. For example, one skilled in the art will easily visualize the collimator 10 (not shown) having the collimating elements 11 aligned with every third (fourth, fifth, etc.) collimating element 11 spaced apart in the cross-machine direction. Also, while the planar collimating elements 11, shown in FIGS. 2 and 3, are preferred, the collimating elements having a non-planar configuration, as shown in FIG. 4, may also be used in the collimator 10. It should also be understood that although in the preferred embodiments shown in FIGS. 2 and 3 no other collimating elements than the discrete and non-abutting collimating elements 11 are provided, the collimator 10 may comprise at least one additional (for example, cross-machine-directional) collimating element (not shown) within the open area defined by the frame 15. If desired, such an additional collimating element may provide an intermediate support for the collimating elements 11, or stabilize the entire collimator 10. Of course, other means of the intermediate support may also be used, such as, for example, a cross-machine-directional wire or rod, instead of the additional collimating element. Analogously, a collimating element or elements which is/are disposed at a certain angle or angles (for example, perpendicular) relative to the collimating elements 11 may also be used, if desired. If other than the collimating elements 11 are used in the collimator 10, a machine-directional distance between the collimating elements mutually adjacent in the machine direction should be greater than a cross-machine-directional distance between the collimating elements mutually adjacent in the cross-machine direction—to provide for a greater level of collimation in the cross-machine direction, according to the present invention.

As has been pointed out above, while the principal embodiments of the collimator 10 shown in FIGS. 2, 3, and 3A are preferred, the present invention contemplates an embodiments of the collimator 10, in which the collimating elements 11 have unequal spacing therebetween, and/or differential acute angles $\lambda$ formed between the collimating elements 11 and the machine direction. Moreover, the collimating elements 11 may be curved. As an example, FIG. 4 shows a fragment of the collimator 10 having at least two different types of the collimating elements 11: planar collimating elements 11*a*, 11*b*, 11*d*, and curved collimating elements 11*c*. The collimating elements 11*a* have the cross-machine directional clearance Ba therebetween; the collimating elements 11*b* have the cross-machine directional clearance Bb therebetween; the collimating elements 11*c* have the cross-machine directional clearance Bc therebetween; and the collimating elements 11*d* have the cross-machine directional clearance Bd therebetween. Angles $\lambda$a, $\lambda$b, $\lambda$c, and $\lambda$d are formed between the machine direction and the collimating elements 11*a*, 11*b*, 11*c*, and 11*d*, respectively. For illustration, in FIG. 4 the angles $\lambda$a, $\lambda$b, $\lambda$c, and $\lambda$d are not equal. In FIG. 4, B12 represents a cross-machine-directional distance between the first ends 12 of the adjacent non-parallel collimating elements, and B13 represents a cross-machine directional distance between the second ends 13 of the same adjacent nonparallel collimating elements. As has been explained above, the cross-machine-directional clearance between two adjacent non-parallel collimating elements (i. e., between 11*a* and 11*b*, and between 11*c* and 11*d*) is defined herein as a calculated average between the distance B12 and the distance B13. In accordance with the present invention, each of the machine-directional clearances A (for example, Aa, Aab, Ab, Abc, Ac, and Ad in FIG. 4) is greater than the corresponding cross-machine directional clearance B between the same pairs of the collimating elements 11. The use of the collimator 10 comprising unequally-spaced and/or non-parallel collimating elements may be desirable for constructing a papermaking belt having differential machine-directional (longitudinal) regions.

What is claimed is:

1. A collimator, in combination with a source of curing radiation and a working surface, for use in a process for curing a photosensitive resin disposed on the working surface, wherein the working surface is structured and configured to move in a machine direction relative to said collimator and has a cross-machine direction perpendicular to said machine direction, the collimator comprising a plurality of discrete collimating elements spaced from one another at a distance in the cross-machine direction within an open area through which said curing radiation is capable of reaching said photosensitive resin to cure it, each of said collimating elements being substantially perpendicular to said working surface, wherein at least one pair of mutually adjacent collimating elements form a machine directional clearance A and a cross-machine directional clearance B between said two mutually adjacent collimating elements, said machine-directional clearance A being greater than said cross-machine directional clearance B.

2. The collimator according to claim 1, wherein said acute angle $\lambda$ between the collimating elements and the machine direction is from 1° to 44°.

3. A collimator according to claim 2, wherein said acute angle $\lambda$ between the collimating elements and the machine direction is from 1° to 44°.

4. The collimator according to claim 3, wherein said acute angle $\lambda$ is from 5° to 30°.

5. The collimator according to claim 4, wherein said acute angle $\lambda$ is from 10° to 20°.

6. A collimator, in combination with a source of curing radiation and a working surface, for use in a process for curing a photosensitive resin disposed on the working surface, wherein the working surface is structured and configured to move in a machine direction and has a cross-machine direction perpendicular to said machine direction, the collimator comprising a plurality of mutually parallel collimating elements spaced from one another at a distance in the cross-machine direction within an open area through which said curing radiation is capable of reaching said photosensitive resin to cure it, each of said collimating elements being substantially perpendicular to said working surface, wherein every pair of mutually adjacent collimating elements form a machine-directional clearance A and a cross-machine-directional clearance B between said two mutually adjacent collimating elements, said machine-directional clearance A being greater than said cross-machine directional clearance B, said collimating elements and said machine direction forming an angle $\lambda$ therebetween, the angle $\lambda$ being less than 45°.

7. The collimator according to claim 6, wherein said collimating elements are equally spaced therebetween in the cross-machine direction.

8. The collimator according to claim 7, wherein any machine-directional line through said open area intersects an equal resulting machine-directional thickness of said collimating elements.

9. The collimator according to claims 1 or 6, further comprising a frame supporting said plurality of mutually parallel collimating elements.

10. A collimator, in combination with a source of curing radiation and a working surface, for use in a process for curing a photosensitive resin disposed on the working surface, wherein the working surface is structured and configured to continuously travel in a machine direction and has a cross-machine direction perpendicular to said machine direction, the collimator comprising:

a frame defining an open area through which said curing radiation from said source is capable of reaching said photosensitive resin to cure it; and a plurality of mutually parallel collimating elements consecutively spaced from one another at a distance in the cross-machine direction within said open area, each of said collimating elements having a first end and a second end opposite to said first end, said plurality of collimating elements being oriented within said open area such that the first end of one of said plurality of collimating elements is aligned in the machine direction with the second end of another of said plurality of collimating elements.

11. The collimator according to claim 10, wherein said collimating elements are equally spaced from one another in the cross-machine direction at pitch P, said first ends being spaced from said second ends in the machine direction at a machine-directional distance H.

12. The collimator according to claim 11, wherein an angle $\lambda$ formed between the machine direction and said collimating elements equals to an arctangent nP/H, where n is an integer, the angle $\lambda$ being less than 45°.

13. The collimator according to claim 10, wherein the first end of one collimating element is aligned in the machine direction with the second end of the adjacent collimating element.

14. The collimator according to claim 10, wherein the first end of one collimating element is aligned in the machine direction with the second end of the second collimating element spaced apart from said one collimating element in the cross-machine direction.

15. The collimator according to claim 1, claim 6, or claim 10, wherein at least one of the plurality of collimating elements has a non-planar configuration.

16. The collimator according to claim 1, claim 6, or claim 10, wherein any machine-directional line within the open area intersects an equal resulting projected machine-directional thickness of said collimating elements.

* * * * *

UNITED STATES PATENT AND TRADEMARK OFFICE

CERTIFICATE OF CORRECTION

PATENT NO. : 6,210,644 B1 
DATED : April 3, 2001
INVENTOR(S) : Paul Dennis Trokhan et al.

It is certified that error appears in the above-identified patent and that said Letters Patent is hereby corrected as shown below:

Column 1,
Line 14, "formations" should read -- foraminous --.

Column 5,
Line 66, "08/1799,852" should read -- 08/799,852 --.

Column 12,
Line 56, claim 2 should read as follows:
-- 2. The collimator according to Claim 1, wherein said mutually adjacent collimating elements and said machine direction form an acute angle $\lambda$ therebetween. --.

Signed and Sealed this

Eighteenth Day of June, 2002

*Attest:*

*Attesting Officer*

JAMES E. ROGAN
*Director of the United States Patent and Trademark Office*